US006723036B2

(12) United States Patent
Weaver et al.

(10) Patent No.: US 6,723,036 B2
(45) Date of Patent: Apr. 20, 2004

(54) METHODS AND APPARATUS FOR FOLDING SHEET MATERIAL

(75) Inventors: Richard A. Weaver, Linden, MI (US); John W. Schaefer, Burton, MI (US); Michael G. Howe, Holly, MI (US)

(73) Assignee: Contour Fabricators, Inc., Fenton, MI (US)

( * ) Notice: Subject to any disclaimer, the term of this patent is extended or adjusted under 35 U.S.C. 154(b) by 0 days.

(21) Appl. No.: 10/174,922

(22) Filed: Jun. 19, 2002

(65) Prior Publication Data

US 2003/0236157 A1 Dec. 25, 2003

(51) Int. Cl.[7] ..... B21C 47/00; B65B 63/04; B65H 19/28

(52) U.S. Cl. ..... 493/450; 493/243; 493/447; 493/457; 493/456; 242/532.2; 242/533.7; 242/581

(58) Field of Search ..... 493/243, 447, 493/450, 457, 456; 280/743.1, 728.1; 242/532.2, 581, 533.3, 533.7

(56) References Cited

U.S. PATENT DOCUMENTS

| | | | | |
|---|---|---|---|---|
| 2,538,671 A | | 1/1951 | Crowe | |
| 3,038,718 A | | 6/1962 | Balsam | |
| 3,261,268 A | | 7/1966 | Tipper | |
| 3,671,033 A | | 6/1972 | Coast | |
| 3,802,639 A | * | 4/1974 | Dowd, Jr. | 242/533 |
| 3,918,698 A | | 11/1975 | Coast | |
| 4,180,256 A | | 12/1979 | Coast | |
| 4,183,515 A | | 1/1980 | Coast | |
| 4,245,829 A | | 1/1981 | Coast | |
| 4,285,687 A | | 8/1981 | McDonald | |
| RE35,265 E | * | 6/1996 | Baker | 493/405 |
| 5,531,660 A | | 7/1996 | Biese et al. | |
| 5,538,199 A | * | 7/1996 | Biagiotti | 242/541.2 |
| 5,669,204 A | * | 9/1997 | Blaisdell | 53/429 |
| 5,716,312 A | * | 2/1998 | Kristel | 493/245 |
| 5,779,180 A | * | 7/1998 | Smedt et al. | 242/528 |
| 5,797,559 A | * | 8/1998 | Coffey | 242/527.6 |
| 6,270,034 B1 | * | 8/2001 | Kury et al. | 242/533.4 |

* cited by examiner

*Primary Examiner*—Rinaldi I. Rada
*Assistant Examiner*—Brian Nash
(74) *Attorney, Agent, or Firm*—John K. McCulloch

(57) ABSTRACT

Methods and apparatus for folding pliable sheet material wherein the sheet material is wound on a mandrel to form a roll which subsequently is stripped off the mandrel and transferred to a pleating station at which successive creases are formed in the roll to produce a pleated packet. During the winding of the sheet material the latter is adhered to the mandrel by the application of negative air pressure to the material via the mandrel. Following the formation of the roll, the application of negative air pressure is discontinued and positive air pressure is applied to the interior of the roll so as to facilitate stripping of the roll from the mandrel. At the pleating station the roll is creased successively to form a plurality of pleats and the direction in which the creasing proceeds is such as to facilitate the escape of air from the roll as it is pleated.

31 Claims, 6 Drawing Sheets

METHODS AND APPARATUS FOR FOLDING SHEET MATERIAL

This invention relates to methods and apparatus for folding sheet material to form a pleated packet of such size as to facilitate storage and transport thereof.

BACKGROUND OF THE INVENTION

It is conventional to fold sheet materials in such manner as to form a packet of reduced area so as to facilitate the storage and transport of such packet. One instance in which the folding of sheet material is desirable is in the case of bags of the kind which are needed to assist in providing sterile zones adjacent an area in which surgical or other procedures are performed. Bags of this kind frequently are closed except for an open mouth at one end bounded by an elastic strip which partially closes the bag, but enables the bag to be supported by a suitable frame with the mouth open to shield the adjacent area. Such bags frequently are of large area ranging from 2 to 4 feet in width and 6 feet or more in length. The handling of such bags in unfolded condition is awkward and the preservation of the sterility of such bags is difficult to maintain. Accordingly, it is desirable to fold the bag by forming a plurality of pleats therein and produce a reduced area packet which more easily can be stored, transported, and maintained sterile.

SUMMARY OF THE INVENTION

Pliable sheet material is made into a bag having an open mouth at one end thereof which may be banded by elastic so as to cause the mouth to be urged toward a closed condition. The bag thus is formed of two layers of such sheet material and is closed along three of its sides, one of such sides constituting the bottom of the bag and the bottom being opposite the mouth. One closed side of the bag is introduced to a nip between a pair of rollers one of which constitutes a winding mandrel having openings in its surface in communication with a source of air pressure which selectively can be negative or positive. The mandrel is rotated so as to cause the bag to be wound convolutely into a roll, vacuum being applied to the bag via the openings in the mandrel to secure the sheet material on the mandrel and assure formation of a tightly convoluted roll. As the bag is rolled, an operator may maintain the elastically banded edge of the bag in stretched condition to avoid bunching of the sheet material.

Following completion of the roll the application of vacuum is discontinued and positive pressure is applied through the mandrel to the inner surface of the roll so as to enable the latter easily to be stripped from the mandrel. A clamp is applied to one end of the roll and the clamp moved in a direction to strip the roll from the mandrel. The roll is transferred to a position in which a portion of the roll overlies a pleating station at which a plurality of blades may be operated sequentially to crease the bag and form a pleated packet having a plurality of adjacent pleats.

Following pleating of the roll the clamp is released and the pleated packet is ejected from the pleating station for packaging or storage.

THE DRAWINGS

Apparatus especially adapted for use in performing the preferred method is disclosed in the accompanying drawings wherein.

THE PREFERRED EMBODIMENTS

Figure 1:
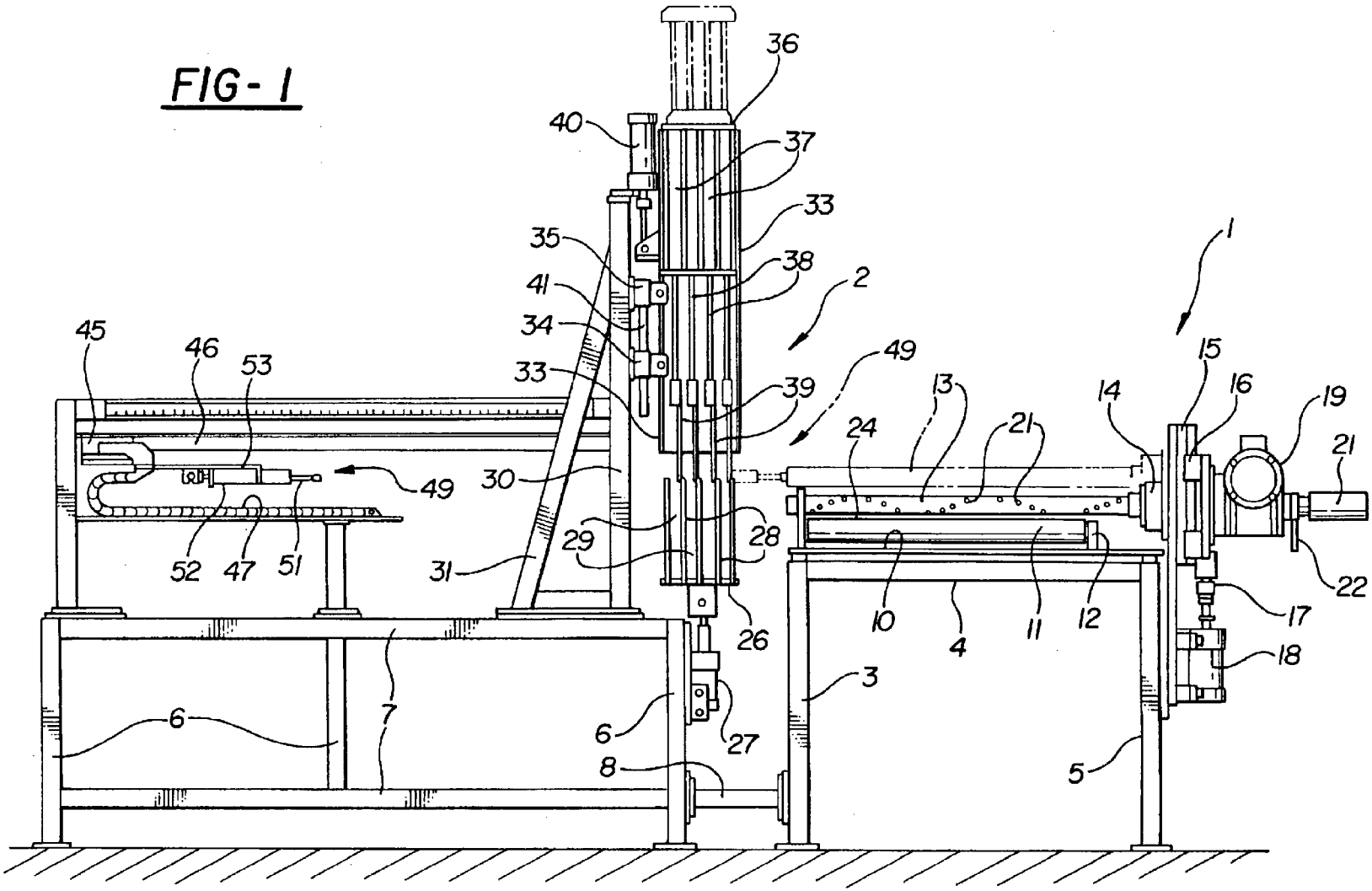
FIG. 1 is a side elevational view of the apparatus.
Figure 2:
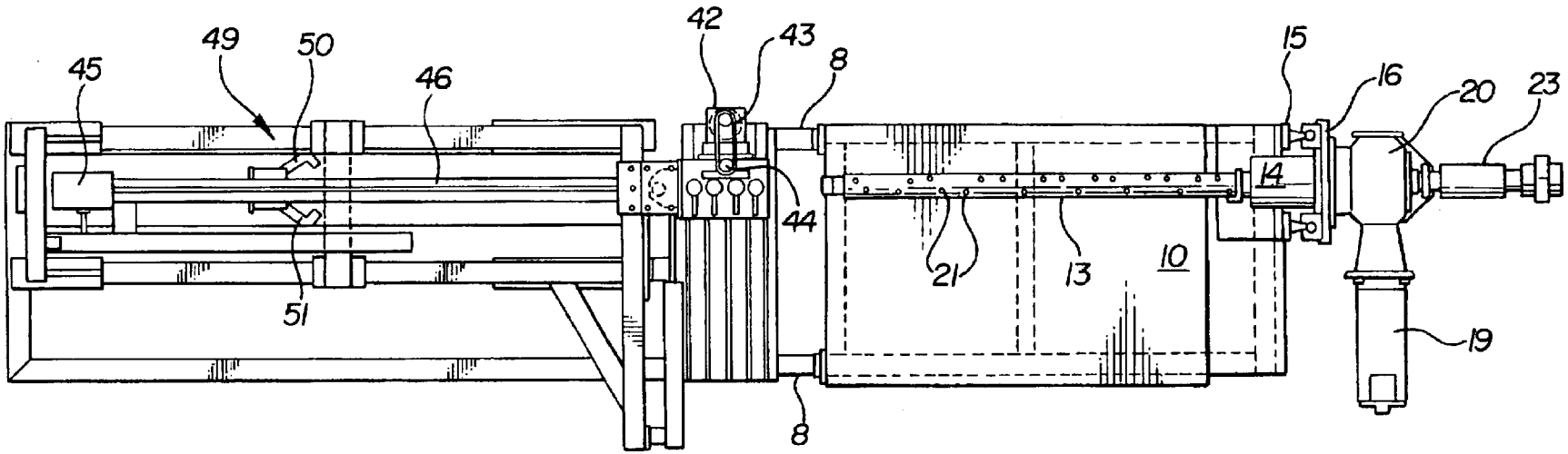
FIG. 2 is a top plan view of the apparatus shown in FIG. 1.
Figure 3:
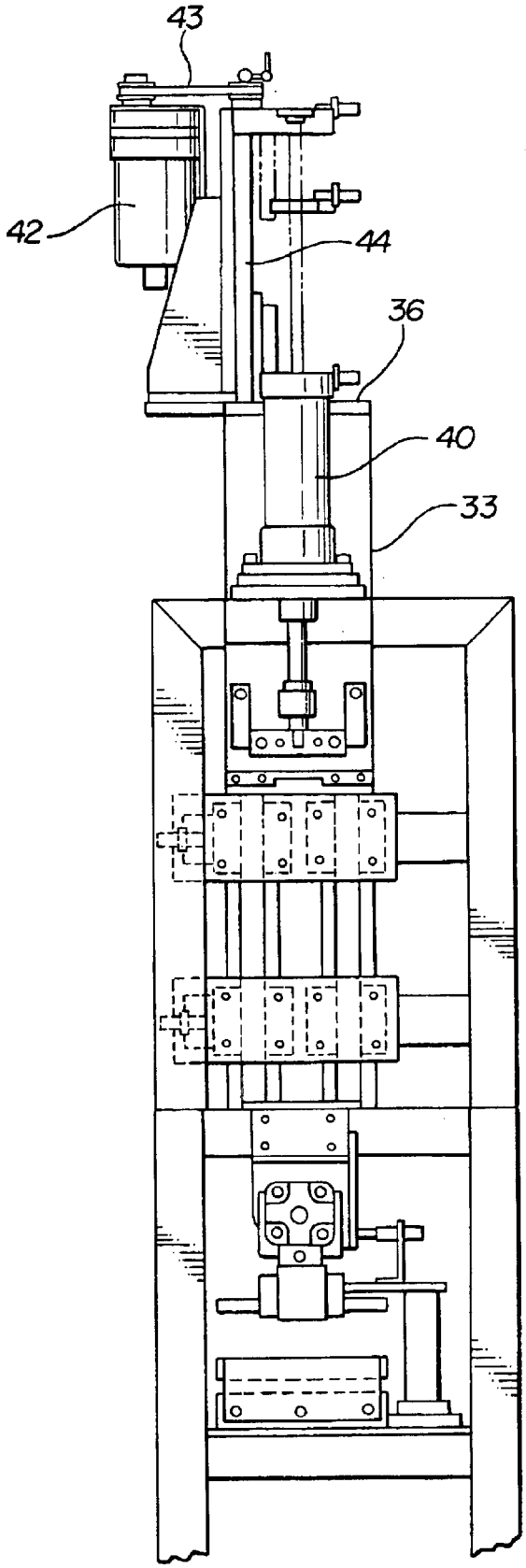
FIG. 3 is a fragmentary elevational view, on an enlarged scale, of the pleating station.
Figure 4:
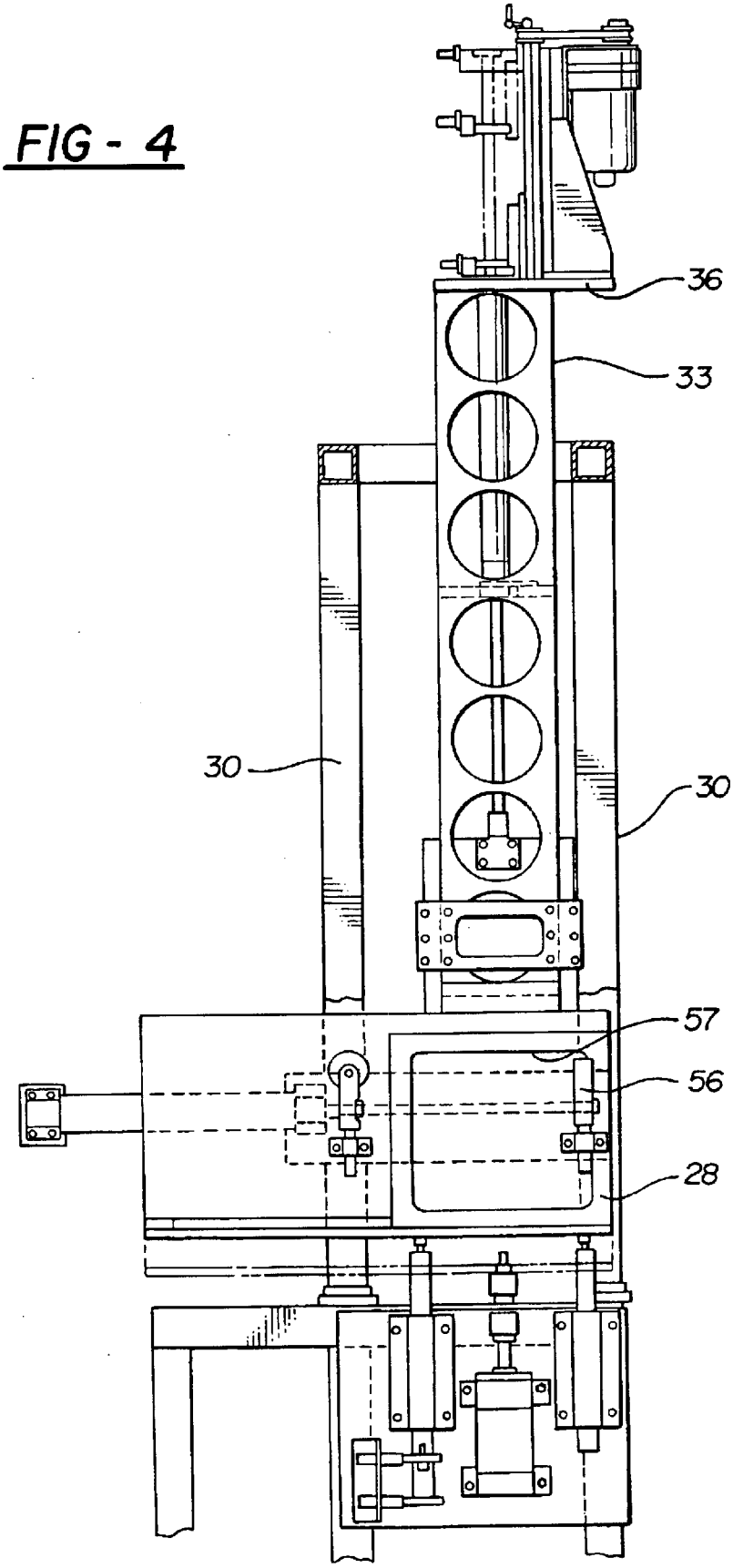
FIG. 4 is an elevational view of the apparatus shown in FIG. 3, but from a position rotated through 90°.
Figure 6:
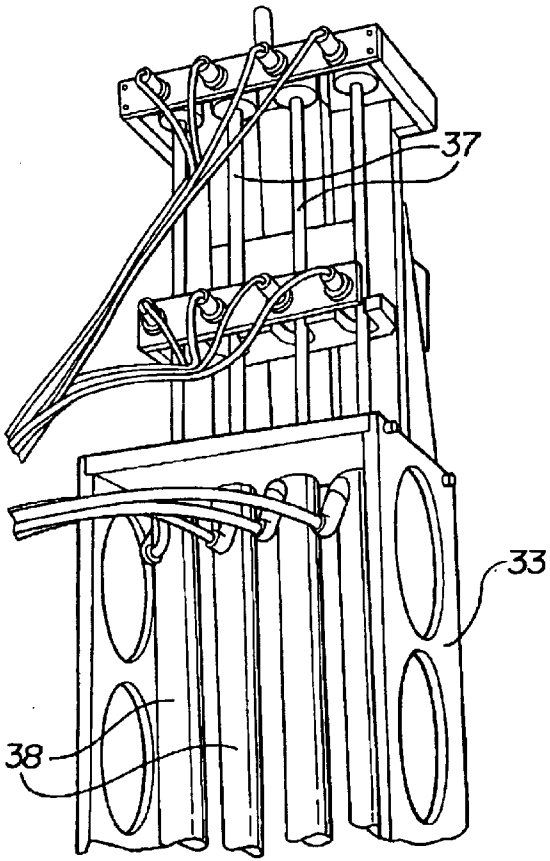
FIG. 6 is an isometric view, on an enlarged scale, of a portion of the pleating mechanism.

Apparatus constructed in accordance with the preferred embodiments of the invention comprises a winding or roll-forming station 1 and a pleating station 2, the roll-forming station being supported by a first frame section having members 3, 4, and 5 and the pleating station being supported by a second frame section having appropriate vertical and horizontal frame members 6 and 7, respectively. The two frame sections are joined together in spaced relation by couplings 8.

The winding station 1 has a horizontal table top or platform 10 on which is mounted an idler roller 11 for rotation about a fixed axis. Directly above the roller 11 is a mandrel 13 journaled in a support 14 which is mounted for vertical movements via a guide 15 and a slide 16. The slide 16 is coupled by a linkage 17 to a pneumatic or hydraulic cylinder 18 by means of which the slide is vertically adjustable.

The mandrel 13 is coupled to an electric drive motor 19 via a transmission 20 of known construction and has a plurality of helically arranged openings 21 which communicate with an air pump 21 via a line 22. Suitable and conventional valving (not shown) enables the pressure of air at the mandrel openings 21 to be either negative or positive, as desired. As is best shown in FIG. 1 the mandrel 13 directly overlies the idler roller 11 so as to form a nip 24 therebetween. The height of the nip is adjustable via the cylinder 18.

The pleating station 2 comprises a base 26 coupled to a pneumatic or hydraulic cylinder 27 so as to enable the base 26 to be raised and lowered. Carried by the base 26 is a plurality of uniformly spaced, upstanding vanes 28 which define a plurality of parallel, spaced apart slots 29 open at their upper ends.

Upstanding frame members 30 and braces 31 support a vertically shiftable frame 33 via couplings 34 and 35. The frame 33 has a cap 36 at its upper end. The cap has a plurality of side by side, spaced openings for the accommodation of a corresponding plurality of pneumatic or hydraulic cylinders 37 having piston rods 38 coupled at their lower ends to a corresponding plurality of pleating blades 39 which register with the slots 29. The frame 33 is vertically adjustable via a cylinder 40 that is secured to the upstanding frame member 30. Movements of the frame 33 are guided by one or more guide rods 41 which extend through the couplings 34, 35. The maximum height to which the frame 33 may be elevated is indicated by chain lines in FIG. 1. The objective in elevating the frame 33 is to assist in the provision of a gap of predetermined height between the lower ends of the blades 39 and the upper ends of the vanes 28, the purpose of which will be explained shortly.

A fine height adjustment for the frame 33 is provided by a hydraulic motor 42 carried by the frame and coupled by a drive transmitting belt and pulley assembly 43 to an adjusting screw 44 which extends through a threaded nut (not shown) fixed in the cap 36. The fine adjustment controls the at-rest spacing between the frame 33 and the vanes 28, and the depth that the blades 39 may be plunged into the slots 29.

A reciprocable transfer carriage 45 is mounted on a track 46 for movements toward and away from the winding station 1 and the pleating station 2. The carriage 45 includes a linear motor and a flexible electrical coupling 47 and supports a clamp 49 comprising a pair of claws 50, 51 movable toward and away from one another by a pneumatic or hydraulic cylinder 52. The cylinder 52 is supported by an arm 53 coupled to the carriage 45 and is connected to a source of pneumatic or hydraulic pressure fluid in any conventional manner for the purpose of opening and closing the claws of the clamp.

Figure 5:
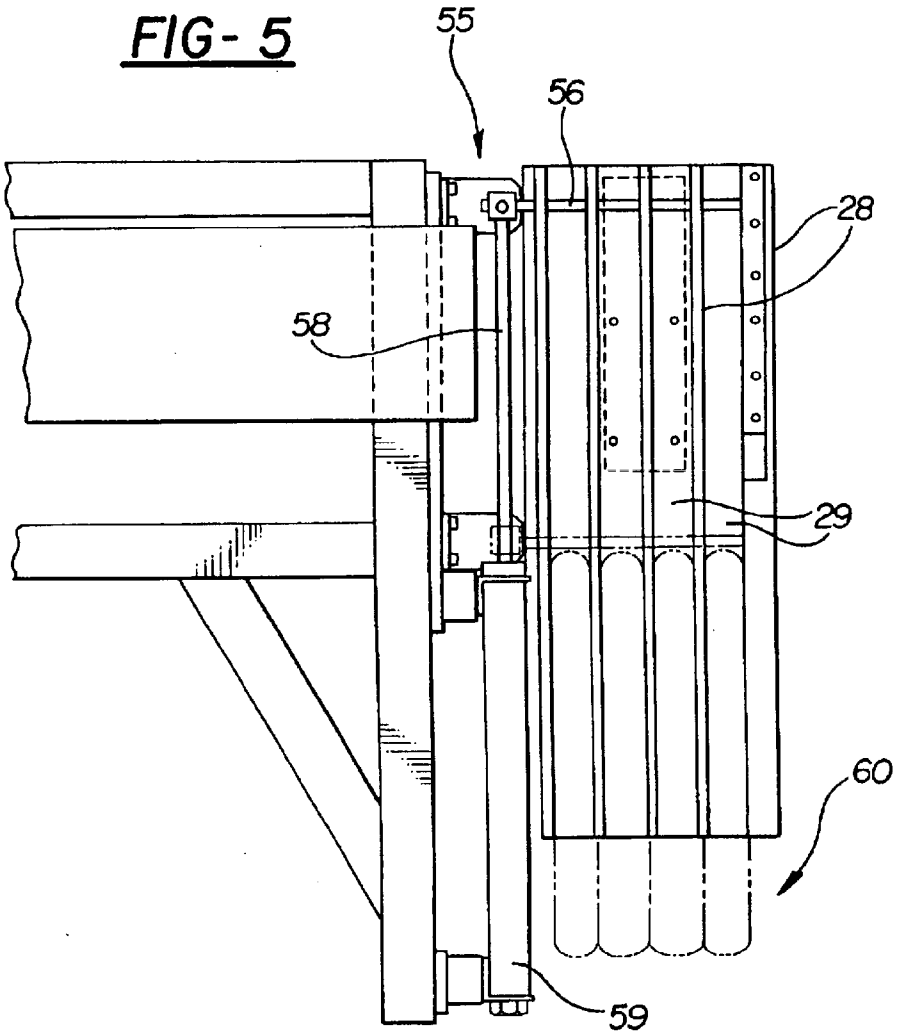
FIG. 5 is a fragmentary top elevational view on an enlarged scale of the pleating station illustrating the ejection of a pleated packet.

The pleating station also includes ejecting means 55 for ejecting from the pleating station a pleated packet formed from a roll. The ejecting means comprises a bar 56 extending through an opening 57 in each of the vanes 28 and coupled to the piston rod 58 of a cylinder 59. The bar 56 normally occupies the position shown in full lines in FIG. 5, but in response to movement of the piston rod 58 in one direction, is movable to the position shown in chain lines in FIG. 5 thereby enabling a pleated packet 60 formed from the rolled bag to be ejected from the pleating station to a position in which the packet may be gripped and removed by an operator.

To condition the apparatus thus far described for operation the mandrel 13 occupies the position shown in full lines in FIG. 1 and the transfer carriage 45 and clamp 49 also occupy the positions shown in full lines in FIG. 1. The sheet material from which the packet 60 is to be formed is positioned on the table top 10 so that one end of the material may be introduced to the nip 24 between the idler roller 11 and the mandrel 13. If the material comprises a bag, there will be two layers of such material introduced to the nip. However, it is possible to restrict the material to a single thickness if it is desired simply to form a packet from a single layer of sheet material.

As the one end of the sheet material is introduced to the nip the mandrel 13 will be rotated and negative air pressure or suction will be applied to the surface of the mandrel via the openings 21. The negative pressure will cause the sheet material to adhere to the surface of the mandrel so that the sheet material may be convolutedly wound about the mandrel and form a tightly wound roll. As the roll is formed its diameter will increase and the position of the mandrel 13 may be adjusted vertically by the cylinder 18 to accommodate the increasing diameter.

When the sheet material has been wound to form a roll of desired diameter, the winding is terminated and positive pressure air is applied to the interior of the roll via the openings 21 in the mandrel. The positive pressure air will enable the roll easily to be stripped off the mandrel.

Following formation of the roll the base 26 and the pleating vanes 28 are lowered to a position which forms the aforementioned gap that enables free movement of the transfer carriage 45 and the clamp 49 across the pleating station to a position in which the claws of the clamp 49 may grip the adjacent end of the roll. The clamp claws are closed, thereby gripping or clamping one end of the roll. The carriage 45 then may be moved to the left, as viewed in FIG. 1, transferring the roll to a position in which its left hand or leading end registers with the left-most vane 28. The blade 39 which is in register with the left-most slot 29 then may be plunged into such slot, thereby creasing and forming a pleat in that portion of the roll which overlies the slot 29 at the left hand end of the pleating station. As the blade 39 moves into the slot the leading end of the roll is stationary because it is clamped by the claws of the clamp. Accordingly, the roll is further stripped off the mandrel 13, thereby causing the trailing end to move to the left. Following the formation of the first pleat in the roll, the blade 39 which occupies the endmost slot 29 remains in that position and the next adjacent blade is moved into the associated slot so as to crease and form a second pleat in the roll. As the second pleat is formed, the first pleat remains in place in the endmost slot because of the presence therein of the associated blade 39. As the second pleat is formed, the roll is further stripped from the mandrel 13.

The pleating procedure is continued until each of the pleating blades 39 has been plunged into its associated slot 29 in succession, thereby converting the roll into the pleated packet 60. Control of the sequence of movement of the blades 39 into the slots 29 may be provided in a selected one of a number of conventional ways.

At any time following the first or subsequent pleating operation the clamp 49 may be disengaged from the leading end of the roll and returned to its initial or at-rest position. Following completion of the pleating operation all of the blades 39 are moved vertically out of their associated slots to a position clear of the pleated packet. The ejecting mechanism 55 then may be actuated to eject the packet 60 out of the pleating station for removal by an operator. Thereafter, the operation is repeated to form additional pleated packets.

The apparatus and sequence of its operation thus far described are for use in folding a flat sheet or a bag having its opening at the right hand end of the bag. It will be understood that, if the open end of the bag is at the right hand end of the pleating station, sequential movement of the pleating blades from left to right into the respective slots 29 will enable any air trapped in the bag to be expelled from the open end thereof as the pleating stages progress from left to right, as shown in FIG. 1. In those instances in which a bag has its opening facing to the left, however, a different pleating sequence must be followed, thereby requiring a minor modification of the apparatus shown in FIG. 7. Except for such modification, all other characteristics of the apparatus are as previously described.

Figure 7:
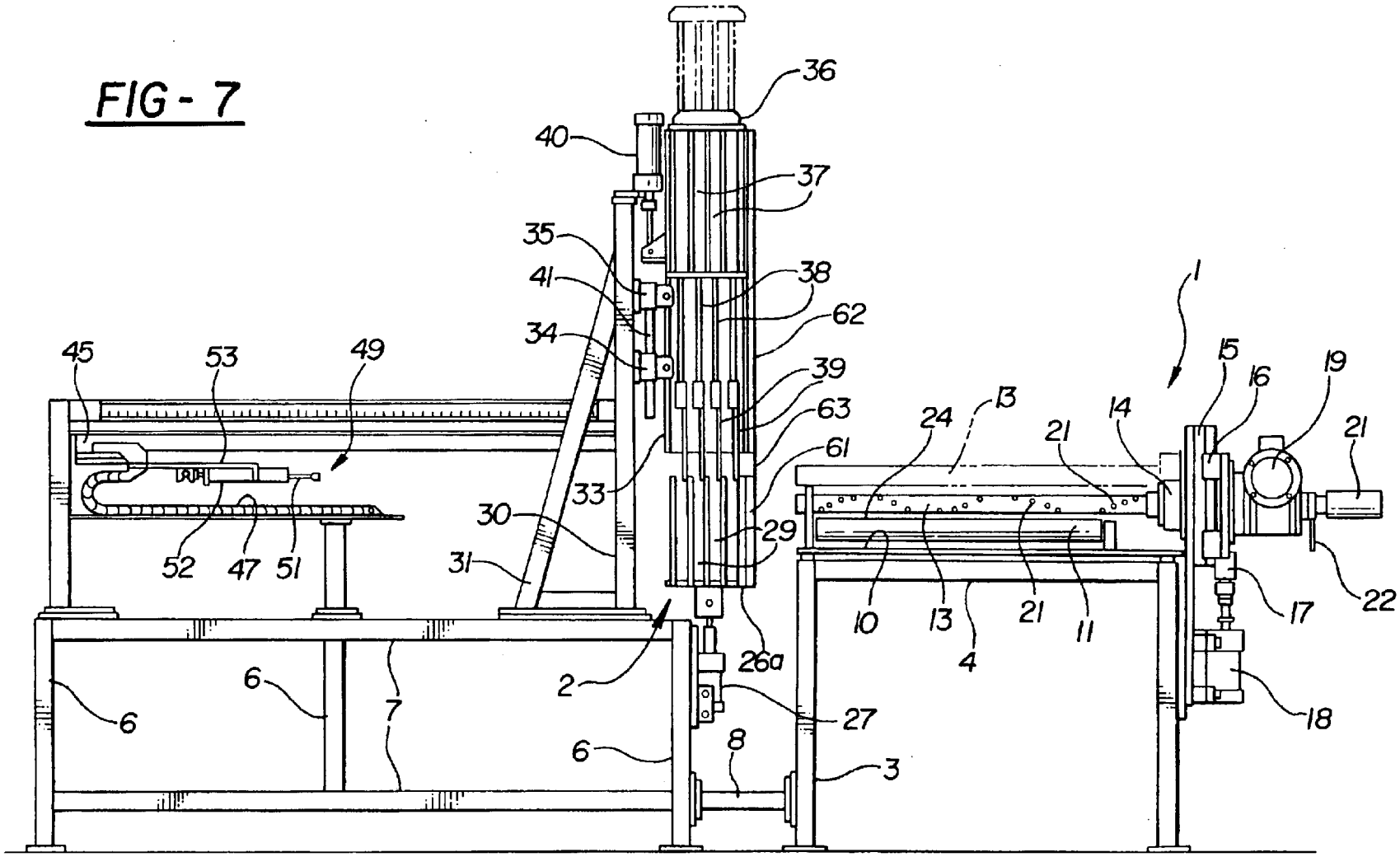
FIG. 7 is a view similar to FIG. 1 of a modified embodiment.

In the modified apparatus shown in FIG. 7 the pleating station 2 has a somewhat extended base 26*a* on which is supported an upstanding bearing wall 61. The frame 33 is provided with a vertically extending support plate 62 that is secured to the frame and terminates at its lower end in a clamp 63. When the frame 33 is lowered to a position in which the blades 39 are in a position to enter the respective slots 29 the clamp 63 will bear upon the upper end of the bearing wall 61, as is shown in FIG. 7.

In the operation of the apparatus shown in FIG. 7, a bag is wound upon the mandrel 13 in the same manner as described earlier to form a roll. The transfer carriage 45 is moved toward the pleating station 2 to a position in which the clamp 49 may engage the adjacent or leading end of a roll wound on the mandrel 13, following which the carriage 45 may be moved to the left a distance sufficient to enable the right hand or trailing end of the rolled bag to overlie the wall 61. At this time the carriage 33 may be lowered to a position in which the clamp 63 overlies and bears against the wall 61 so as to clamp the trailing end of the rolled bag firmly against the wall 61. At this time the clamp 49 may be activated so that the claws 51 release the leading end of the bag.

Following clamping of the trailing end of the bag to the wall 61 and release of the leading end of the rolled bag by the clamp jaws 51, the blades 39 may be plunged into the slots 29 sequentially from right to left, as viewed in FIG. 7, thereby enabling the roll to be formed into the pleated packet 60. By commencing pleating from the trailing end of the rolled bag and continuing sequentially toward the leading end, whatever air is within the rolled bag will be expelled from the leading end thereof during the pleating operation.

Following forming of the packet 60 and returning of the transfer carriage to its initial position the frame 33 may be raised to unclamp the trailing end of the roll and raise the pleating blades out of the slots. The ejecting mechanism 55 then may be actuated as described earlier to eject the packet from the pleating station, whereupon the operation may be repeated to form another pleated packet from a bag.

It will be understood that the movements of the movable parts of the apparatus may be controlled by electric motors or fluid actuators and that the necessary timing of the movements may be controlled by various switches or computer generated signals as is well known in the art.

The disclosed embodiments are representative of presently preferred forms of the invention, but are intended to be illustrative rather than definitive thereof. The invention is defined in the claims.

What is claimed is:

1. A method of folding a bag formed of overlying sheets of pliable material, said bag being closed except for an open mouth at one side thereof, said method comprising:

winding said bag to form a roll having said mouth at one end of said roll;

moving said roll to a pleating station; and creasing said roll successively at a plurality of spaced zones in a direction toward said one end of said roll to form a packet having a plurality of pleats, the successive creasing of said roll in said direction enabling air to be expelled from said bag through the mouth thereof.

2. The method according to claim 1 including winding said bag convolutely about a revolvable mandrel to form said roll.

3. The method according to claim 2 including adhering said bag to said mandrel by the application to said bag of negative air pressure during the winding of said bag.

4. The method according to claim 3 including discontinuing the application of negative air pressure to said bag following the forming of said roll.

5. The method according to claim 4 including applying positive air pressure to said bag following the discontinuance of the application of said negative air pressure.

6. The method according to claim 2 including removing said roll at least partially from said mandrel following the forming of said roll and prior to the creasing of said roll.

7. The method according to claim 1 including clamping said roll at one end during the creasing of said roll.

8. The method according to claim 7 including unclamping said roll following completion of the pleating thereof.

9. The method according to claim 1 including removing the packet from said pleating station.

10. A method of folding a bag formed of two overlying sheets of pliable material, said bag being closed except for an open mouth at one side of said bag, said method comprising arranging said bag so that said mouth faces in one direction;

winding said bag about a rotary mandrel to form a roll having said mouth at one end of said roll;

transferring said roll to a pleating station;

clamping said roll at that end thereof opposite said one end;

creasing said roll at said pleating station a plurality of times in succession in a direction from said opposite end toward said one end while maintaining the clamping of said opposite end of said roll thereby forming a pleated packet from said roll; and unclamping said opposite end of said roll following the creasing thereof.

11. The method according to claim 10 including adhering said bag to said mandrel by applying suction via said mandrel to that sheet underlying the other of said sheets during the winding of said bag about said mandrel.

12. The method according to claim 11 including discontinuing the application of suction to said underlying sheet following the forming of said roll.

13. The method according to claim 12 including applying positive pressure to said underlying sheet via said mandrel following discontinuing the application of suction, thereby facilitating the stripping of said roll from said mandrel.

14. The method according to claim 10 including removing said pleated packet from said pleating station.

15. Apparatus for folding overlying sheets of pliable material forming a bag closed except for an open mouth at one side of said bag, said apparatus comprising:

rotatable mandrel means for winding said bag into a roll having said mouth at one end of said roll;

means forming a pleating station;

transfer means for transferring said roll to said pleating station; and pleating means at said pleating station operable to crease said roll at successive zones in a direction toward said mouth and form a pleated packet from said roll, the successive creasing of said roll enabling air within said bag to be expelled through said mouth.

16. The apparatus according to claim 15 including means for applying negative air pressure via said mandrel to said bag during the winding thereof.

17. The apparatus according to claim 16 including means for terminating the application of negative air pressure to said bag following the winding thereof.

18. The apparatus according to claim 15 wherein said transfer means includes gripping means for gripping said roll at that end thereof opposite said mouth during the transfer of said roll to said pleating station.

19. The apparatus according to claim 18 wherein said pleating means comprises a plurality of slots spaced from one another and a plurality of correspondingly spaced blades movable into and out of said slots, said roll overlying said slots when the roll is at said pleating station thereby enabling pleating of said roll in response to movements of said blades into said slots.

20. The apparatus according to claim 19 including means for moving said blades into said slots successively.

21. The apparatus according to claim 20 including means for withdrawing said blades from said slots following the formation of said packet.

22. The apparatus according to claims 18 including means for releasing said gripping means from said roll following the pleating thereof.

23. The apparatus according to claim 15 including means for removably clamping one end of said roll during the creasing thereof.

24. The apparatus according to claim 21 including ejecting means for ejecting a pleated packet from said pleating station.

25. Apparatus for folding a bag formed of overlying sheets of pliable material, said bag being closed except for an open mouth at one side thereof, said apparatus comprising:

a rotatable mandrel on which said bag may be wound to form a cylindrical roll having opposite ends, said mouth of said bag being at one end of said roll, said mandrel having air passages in communication with its surface;

air pressure control means for selectively establishing negative and positive air pressure at the surface of said mandrel for respectively enabling and disabling adherence of said bag to the surface of said mandrel;

a pleating station spaced from said mandrel;

releasable gripping means operable to grip said roll at an end thereof following winding of said bag about said mandrel;

transfer means coupled to said gripping means and operable to transfer said roll from said mandrel to said pleating station; and pleating means at said pleating station for creasing said roll successively at a plurality of zones between its ends and in a direction toward said one end thereof to form a pleated packet having a plurality of pleats adjacent one another, the successive creasing of said roll enabling air within said bag to be expelled through said mouth.

26. The apparatus according to claim 25 including means for releasing said gripping means from said roll following the pleating thereof.

27. The apparatus according to claim 25 including ejecting means at said pleating station for ejecting said pleated packet from said station.

28. The apparatus according to claim 25 including means for releasing said gripping means from said roll following the transfer of said roll to said pleating station, and means for clamping an end of said roll at said pleating station prior to the creasing of said roll.

29. The apparatus according to claim 25 wherein said pleating station comprises a plurality of adjacent slots and a corresponding plurality of adjacent blades aligned with said slots, each of said blades being movable into and out of that slot with which it is aligned.

30. The apparatus according to claim 29 including drive means coupled to said blades for moving said blades into and out of said slots.

31. The apparatus according to claim 25 including clamp means for removably clamping an end of said roll adjacent one end of said pleating station.

* * * * *